US009725978B2

(12) United States Patent
Gilmore et al.

(10) Patent No.: US 9,725,978 B2
(45) Date of Patent: Aug. 8, 2017

(54) TELESCOPING JOINT PACKER ASSEMBLY

(71) Applicant: Cameron International Corporation, Houston, TX (US)

(72) Inventors: David L. Gilmore, Highlands, TX (US); Brenton J. Greska, Katy, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/582,592

(22) Filed: Dec. 24, 2014

(65) Prior Publication Data

US 2016/0186515 A1 Jun. 30, 2016

(51) Int. Cl.

| | |
|---|---|
| ***E21B 17/08*** | (2006.01) |
| ***E21B 33/035*** | (2006.01) |
| ***E21B 23/06*** | (2006.01) |
| ***E21B 34/04*** | (2006.01) |
| ***E21B 17/01*** | (2006.01) |
| ***E21B 43/10*** | (2006.01) |
| ***E21B 19/00*** | (2006.01) |

(52) U.S. Cl.

CPC ..... *E21B 33/035* (2013.01); *E21B 19/006* (2013.01); *E21B 23/06* (2013.01)

(58) Field of Classification Search

None

See application file for complete search history.

(56) References Cited

U.S. PATENT DOCUMENTS

| | | | | |
|---|---|---|---|---|
| 4,038,632 | A * | 7/1977 | Parker | E21B 34/16 166/72 |
| 4,626,135 | A | 12/1986 | Roche | |
| 4,922,423 | A * | 5/1990 | Koomey | E21B 33/063 166/373 |
| 5,320,235 | A * | 6/1994 | Joyce | B65D 47/0842 215/238 |
| 5,407,172 | A * | 4/1995 | Young | E21B 33/062 137/554 |
| 7,571,772 | B2 * | 8/2009 | Reams | E21B 17/01 166/344 |
| 7,743,823 | B2 * | 6/2010 | Hughes | E21B 41/0021 166/84.3 |

(Continued)

FOREIGN PATENT DOCUMENTS

| | | |
|---|---|---|
| EP | 0272771 A1 | 6/1988 |
| EP | 0531038 A2 | 9/1991 |

(Continued)

*Primary Examiner* — Matthew R Buck
*Assistant Examiner* — Douglas S Wood
(74) *Attorney, Agent, or Firm* — Chamberlain Hrdlicka

(57) ABSTRACT

A packer assembly for dynamically sealing against an inner tubular of a telescoping joint including axially activated packers. The assembly includes an inner housing positionable about the inner tubular of the telescoping joint, the inner housing assembly comprising a packer configured to dynamically seal against the inner tubular of the telescoping joint, and an outer housing assembly positionable about the inner tubular of the telescoping joint and axially below the inner tubular housing, the outer housing comprising a packer configured to dynamically seal against the inner tubular of the telescoping joint.

21 Claims, 8 Drawing Sheets

(56) References Cited

U.S. PATENT DOCUMENTS

| | | | | |
|---|---|---|---|---|
| 8,474,538 | B2 * | 7/2013 | Wallace | E21B 19/006 166/339 |
| 9,121,227 | B2 * | 9/2015 | Thommesen | E21B 17/01 |
| 2003/0029621 | A1 * | 2/2003 | Haynes | E21B 17/06 166/381 |
| 2012/0070225 | A1 | 3/2012 | Wallace et al. | |
| 2012/0160508 | A1 | 6/2012 | Thommesen | |
| 2013/0233573 | A1 | 9/2013 | Ringgenberg et al. | |
| 2014/0138096 | A1 * | 5/2014 | Leuchtenberg | E21B 17/085 166/355 |
| 2014/0203547 | A1 | 7/2014 | Krueger et al. | |
| 2014/0216751 | A1 * | 8/2014 | Liezenberg | E21B 34/045 166/350 |

FOREIGN PATENT DOCUMENTS

| | | | |
|---|---|---|---|
| EP | 0589586 | A2 | 9/1992 |
| GB | 2383385 | A | 6/2003 |

* cited by examiner

TELESCOPING JOINT PACKER ASSEMBLY

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource.

Offshore systems typically include one or more subsea wellheads located at the sea floor. To connect the subsea wellheads to a floating rig (e.g., drill ship, semi-submersible, floating drilling platform, floating production platform, etc.) located at the water surface, a telescoping joint is employed to compensate for surface wave action. The telescoping joint typically is an assembly of an inner tubular surrounded by an outer tubular. The inner and outer tubulars move axially relative to each other to compensate for the required change in the length of the riser string as the floating rig experiences surge, sway and heave.

The telescoping joint is located above the top section of the riser string. The riser string runs from the telescoping joint down to various pressure control equipment packages, such as a lower marine riser package and/or a blowout preventor stack. The pressure control equipment is in place to seal, control and monitor the wellbore. The pressure control equipment is coupled to the subsea wellhead by way of a wellhead connector. The wellhead connector provides bending capacity for the entire assembly. Fluid within the riser flows up through the riser and the inner tubular to a diverter assembly located at the floating rig. The diverter assembly includes a diverter for diverting mud and cuttings, and a flex joint.

Telescoping joints typically include a sealing means in the annular space between the inner and outer tubulars to seal off the fluid contained in the riser. The sealing means is commonly referred to as a "packer" or "packer assembly." The packer assembly prevents fluid or mud loss from the outer tubular into the external environment. Traditionally, telescoping joint packer assemblies included two seals, which are radially energized with air or hydraulics, for forming dynamic seals between the inner tubular and the outer tubular.

An issue with existing packer assemblies is the uncertainty in the wear of the packer assembly seals. Because existing packer assembly seals are radially energized by pressure, either air or hydraulically applied, the load distribution over the packer to inner tubular surface may be uneven. Uneven load distribution results in uneven seal wear and unpredictable seal life.

Because of this uncertainty, existing packer assemblies include two seals. When one seal fails, the other seal functions as a backup seal. After one seal fails, the entire packer assembly must be replaced in order to ensure that backup seal does not fail, exposing the fluid from the riser to the external environment. To replace existing packer assemblies, any fluid in the riser string (e.g., mud) must be circulated out of the riser string. Then a controlled disconnect of the lower marine riser package from the blowout preventor stack is performed. Next, the diverter assembly is removed and the tensioning equipment must be stored before the packer assembly can be landed on a riser spider in a hard hang-off. Only then can the packer assembly seals be replaced, which can take as much or more than ten hours of time. After replacing the seals, the entire process is reversed. With operating expenses at hundreds of thousands of dollars a day and more, packer assembly seal failure results in considerable expenses.

Accordingly, a telescoping joint packer assembly with more reliable and predictable seal wear is desired.

BRIEF DESCRIPTION OF THE DRAWINGS

For a detailed description of the preferred embodiments of the present disclosure, reference will now be made to the accompanying drawings in which.

DETAILED DESCRIPTION

Figure 1:
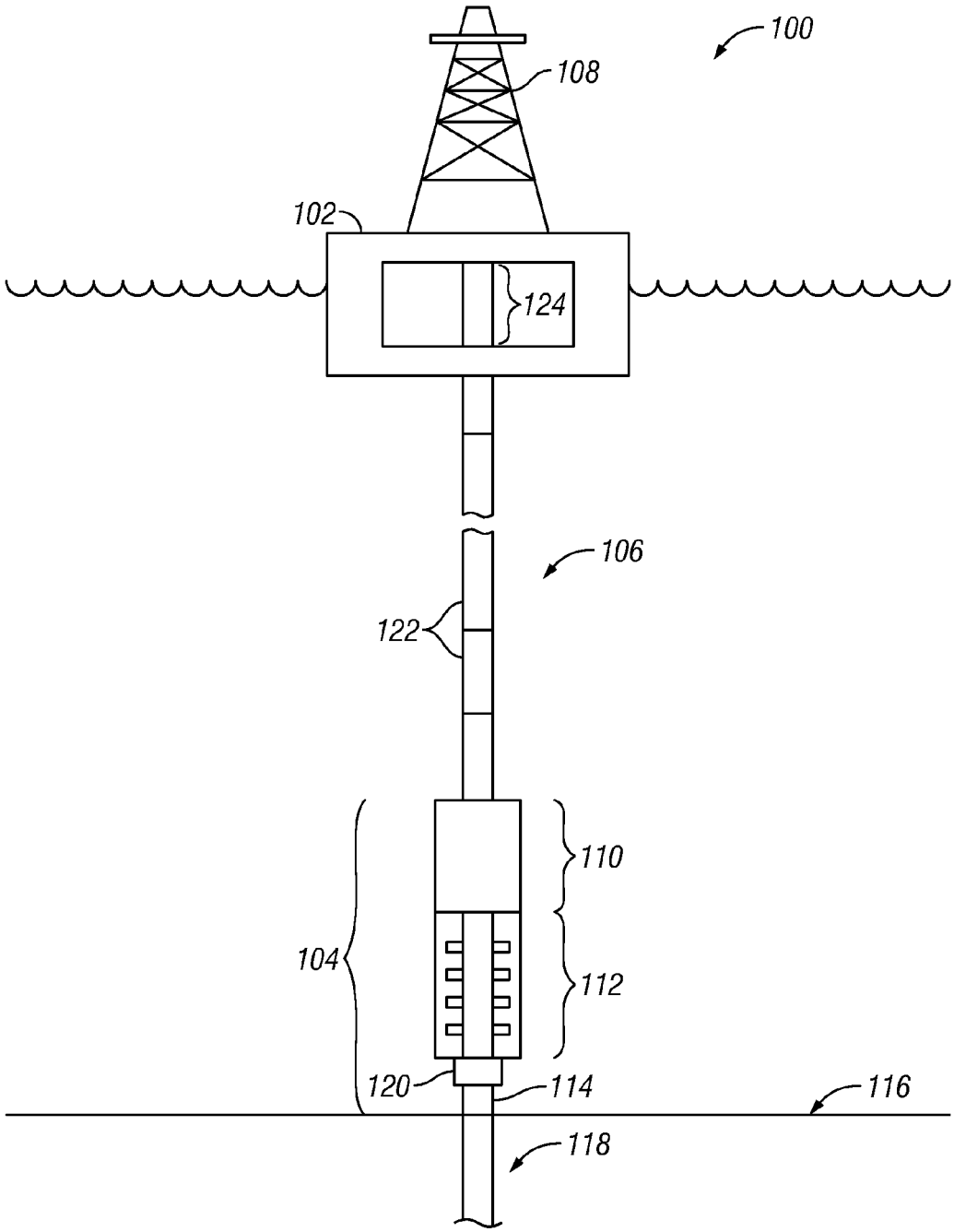
FIG. 1 shows a schematic view of an offshore resource extraction system including a riser extending from a subsea wellhead to a floating rig.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Turning now to the present figures, a resource extraction system 100 is illustrated in FIG. 1 in accordance with one or more embodiments of the present disclosure. Notably, the system 100 facilitates extraction of a resource, such as oil or natural gas, from a well. The system 100 includes a surface platform 102 and subsea equipment 104, with a riser 106 therebetween. The surface platform 102 has a rig 108 and other surface equipment (not shown) for operating the system 100. The subsea equipment 104 comprises a lower marine riser package 110 and a blowout preventor 112 positioned above a wellhead 114 located on sea floor 116 adjacent a wellbore 118. The blowout preventor 112 is connected to the wellhead 114 by way of a wellhead connector 120.

The riser 106 is a system of tubulars 122 that forms a long tube for joining the drilling rig 108 on the platform 102 to the wellhead 114 on the sea floor 116. The riser 106 may include additional conduits for performing various functions, such as electrical or fluid conduits (e.g., choke and kill, hydraulics, riser-fill-up, etc.) The additional conduits may run along the riser 106 from the surface platform 102 to the subsea equipment 104 either externally or internally to the riser 106.

A telescoping joint 124 may be positioned above the uppermost riser 106 tubular for operatively connecting with the floating platform 102. The telescoping assembly 124 has telescoping portions that permit the platform 102 to adjustably position relative the riser 106, for example, as the platform 102 moves with the sea water.

Figure 2:
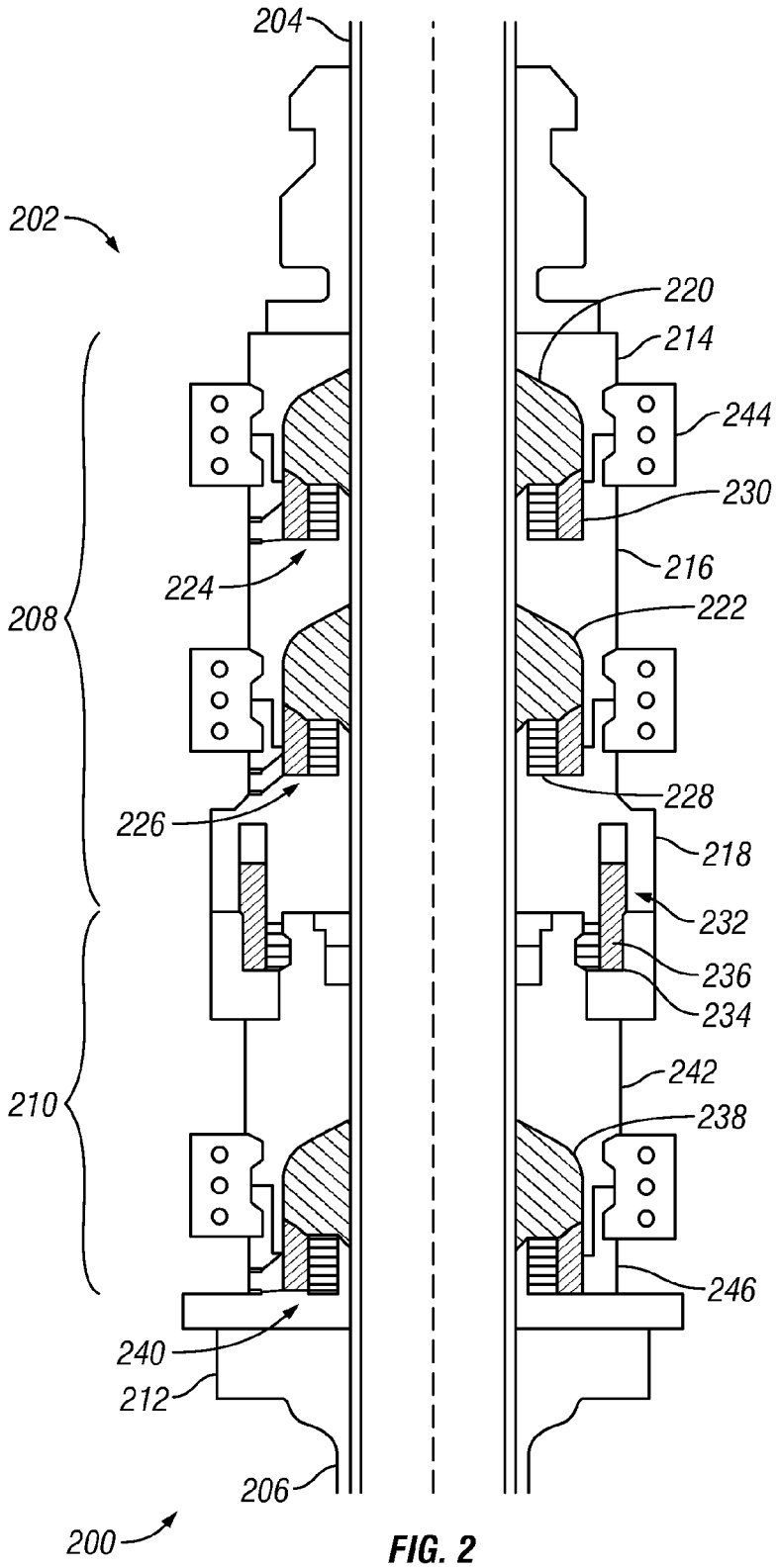
FIG. 2 shows a cross-sectional view of a telescoping joint packer assembly.

A cross-sectional view of a telescoping joint 200 including a packer assembly 202 according to an embodiment of the present invention is illustrated in FIG. 2. The packer assembly 202 comprises an inner tubular 204 and an outer tubular 206 which are moveable axially relative to one another. The inner tubular 204 is slidably disposed within the outer tubular 206. An annular space is defined between the inner tubular 204 and the outer tubular 206. The outer tubular 206 of the telescoping joint 200 is coupled to the uppermost section of a subsea riser (not shown). The packer assembly 202 is disposed about the inner tubular 204 and configured to seal against the outer surface of the inner tubular 204.

The illustrated packer assembly 202 includes an inner tubular housing 208 and an outer tubular housing 210. The inner tubular housing 208 is disposed about the inner tubular 204 and axially from the outer tubular housing 210. The outer tubular housing 210 is disposed about the inner tubular 204 above an outer tubular flange 212. The outer tubular flange 212 is configured to be coupled to the uppermost section of a subsea riser (not shown).

The inner tubular housing includes an upper housing 214, an intermediate housing 216, and a lower housing 218. The upper housing 214 includes an upper primary packer 220. The intermediate housing 216 includes an intermediate primary packer 222. The outer tubular housing 210 includes an outer housing 242 comprising a secondary packer 238 and a lower outer housing 246. Upper primary packer 220, intermediate primary packer 222, and secondary packer 238 are configured to seal against the outer surface of the inner tubular 204. In the illustrated embodiment, the upper primary packer 220 and/or the intermediate primary packer 222 seal about the inner tubular 204 of the telescoping joint 200 during normal operation of the telescoping joint 200. The upper primary packer 220 and intermediate primary packer 222 can be energized independently of each other, i.e., both upper primary packer 220 and intermediate primary packer 222 can be energized at the same time, only one of primary packer 220 and intermediate packer 222 can be energized, or neither primary packer 220 nor intermediate packer 222 can be energized. The secondary packer 238 is capable of sealing about the inner tubular 204 of the telescoping joint 200 when the primary packers 220, 222 are not sealing about the inner tubular 204, such as when the primary packers 220, 222 are being replaced.

The packers 220, 222, 238 are energized by axially-oriented piston assemblies 224, 226, 240, respectively. Piston assemblies 224, 226, 240 are illustrated as dual piston ring assemblies, each comprising an inner piston ring 228 and an outer piston ring 230. However, any piston assembly suitable for axially activating a packer and known to those of ordinary skill in the art is envisioned. For instance, in some embodiments the piston assemblies 224, 226, 240 can be a single piston ring. In other embodiments, the piston assemblies 224, 226, 240 can include a plurality of piston rings. The number of rings in each piston assembly 224, 226, 240 is independent of the number of rings in the other piston assemblies.

Piston assemblies 224, 226, 240 are oriented along the longitudinal axis of the telescoping joint 200, and are actuated by a signal provided from the surface, such as a hydraulic or electric signal. Each piston assembly 224, 226, 240 can be actuatable independent of or together with the other piston assemblies. Further, the inner piston rings 228 can be actuatable independently from or together with the outer piston rings 230.

In operation, the packers 220, 222, 238 wear over time when energized as a result of the inner tubular 204 moving with respect to the outer tubular 206. Therefore, the dual piston ring assemblies 224, 226, 240 are actuated in multiple stages in order to achieve more wear usage from the respective packers 220, 222, 238. More particularly, as pressure is applied to a packer, the outer piston ring 230 begins moving vertically upwards. After a set distance, the outer piston ring 230 engages the inner piston ring 228, causing it to move vertically upwards as well. The outer piston ring 230 stops moving vertically upwards when it reaches a physical stop (e.g., a shoulder), but the inner piston ring 228 can continue moving until it reaches a separate physical stop. A visual indicator (discussed below) or sensor can be installed to identify when there is little or no travel left for the inner piston ring 228.

Figure 8:
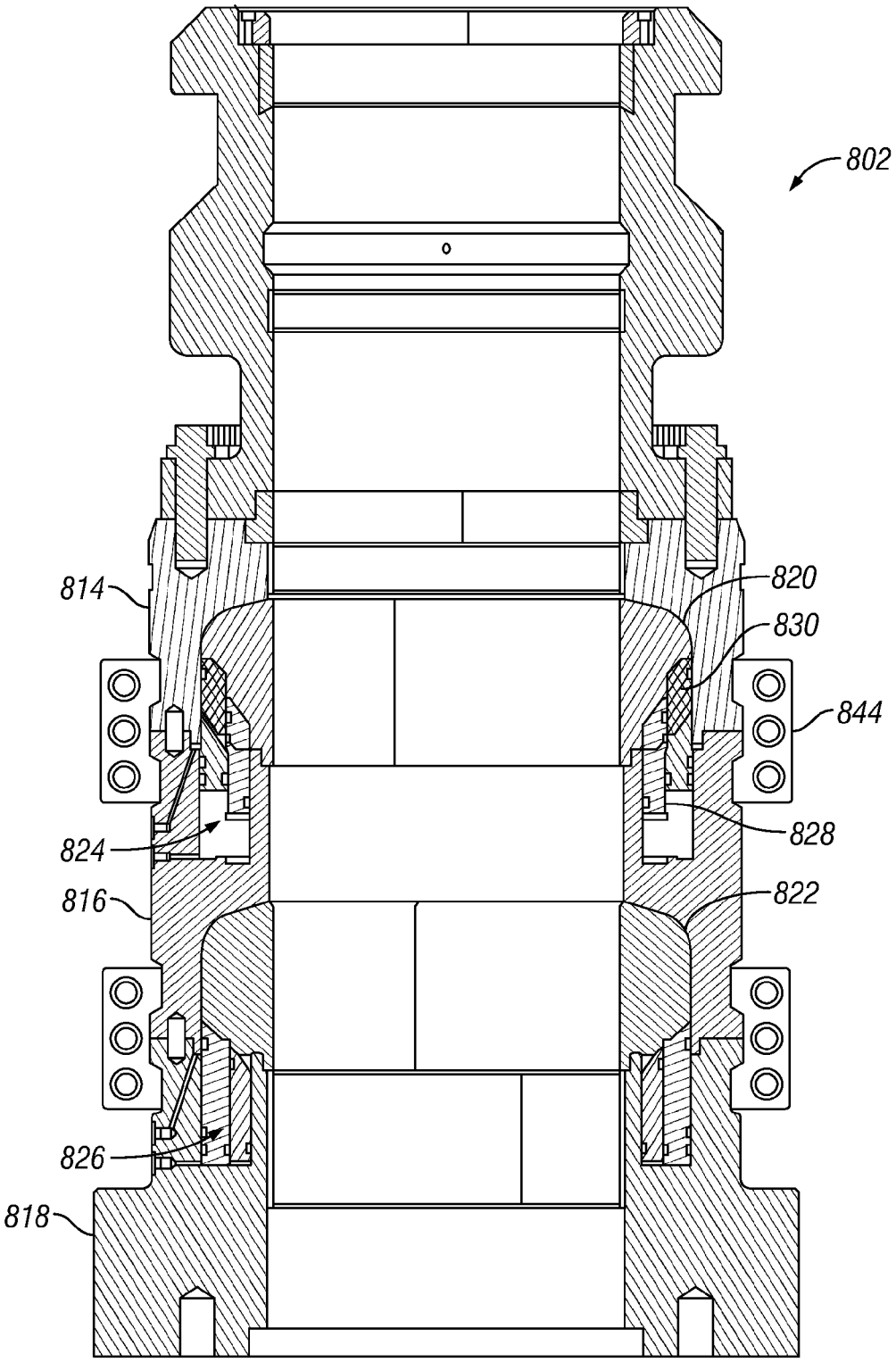
FIG. 8 shows a cross-sectional view of a telescoping joint packer assembly.

Although the embodiment illustrated in FIG. 2 shows an upper primary packer 220, an intermediate primary packer 222, and secondary packer 238, the number of packers may be varied. For instance, the inner tubular housing 208 may contain only a single packer. In this embodiment, the inner tubular housing 208 would only comprise an upper housing and a lower housing with a packer disposed therein. Alternatively, the inner tubular housing 208 may contain additional intermediate housings comprising additional primary packers so that the total number of packers disposed in the inner tubular housing 208 is two or more. Likewise, the outer tubular housing 210 may contain additional housings and additional secondary packers. In an alternative embodiment, the inner tubular housing 208 may bolt directly to the outer tubular flange 212, as illustrated in FIG. 8 and discussed below. This arrangement eliminates the need for the outer tubular housing 210. This may be the case when retrofitting an inner tubular housing to an existing rig.

Figure 3:
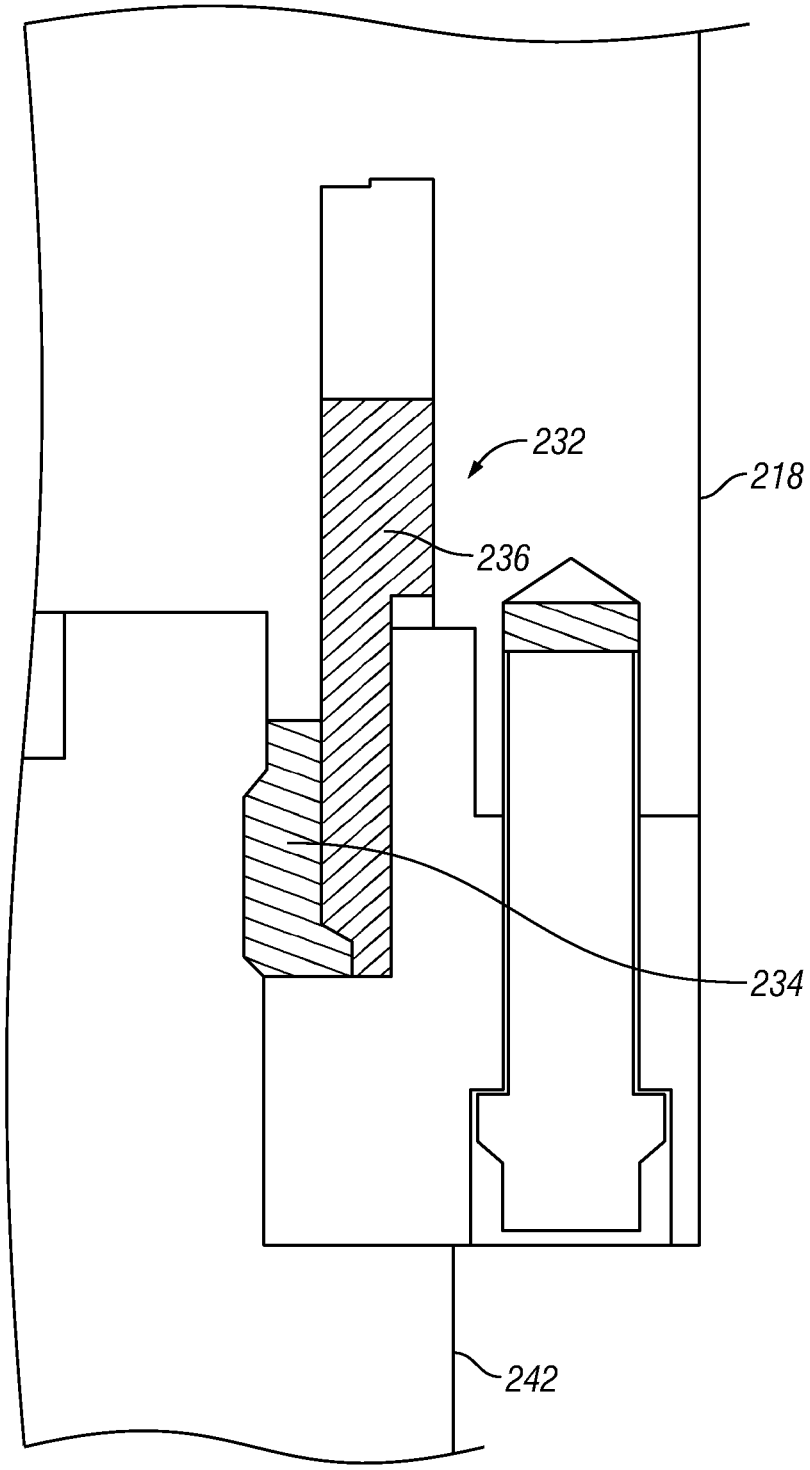
FIG. 3 shows a partial cross-sectional view of a telescoping joint packer assembly including a disconnect assembly.

FIG. 3 illustrates a detailed view of a portion of the lower housing 218. The lower housing 218 includes a disconnect assembly 232 that allows for the inner tubular housing 208 to be separated from the outer tubular housing 210. The disconnect assembly 232 comprises a disconnect lock ring 234 and a disconnect piston ring 236. The disconnect assembly 232 can be manipulated between a locked position in which the inner tubular housing 208 and outer tubular housing 210 are connected, and an unlocked position in which the inner tubular housing 208 and outer tubular housing 210 are separable.

In operation, the disconnect piston ring 236 is moved vertically upwards by hydraulic or other means. By moving upwards, the disconnect piston ring 236 allows for the disconnect lock ring 234 to disengage with the outer tubular housing 210. By disengaging the disconnect lock 234 with the outer tubular housing 210, the inner tubular housing 208 can be removed. Before disengaging the disconnect lock ring 234 from the outer tubular housing, secondary packer 238 is energized by piston assembly 240. Energizing piston assembly 240 allows for replacement of the primary packers 220 and 222 while keeping the telescoping joint in service as a seal is maintained on the inner tubular 204 via secondary packer 238.

Figure 4:
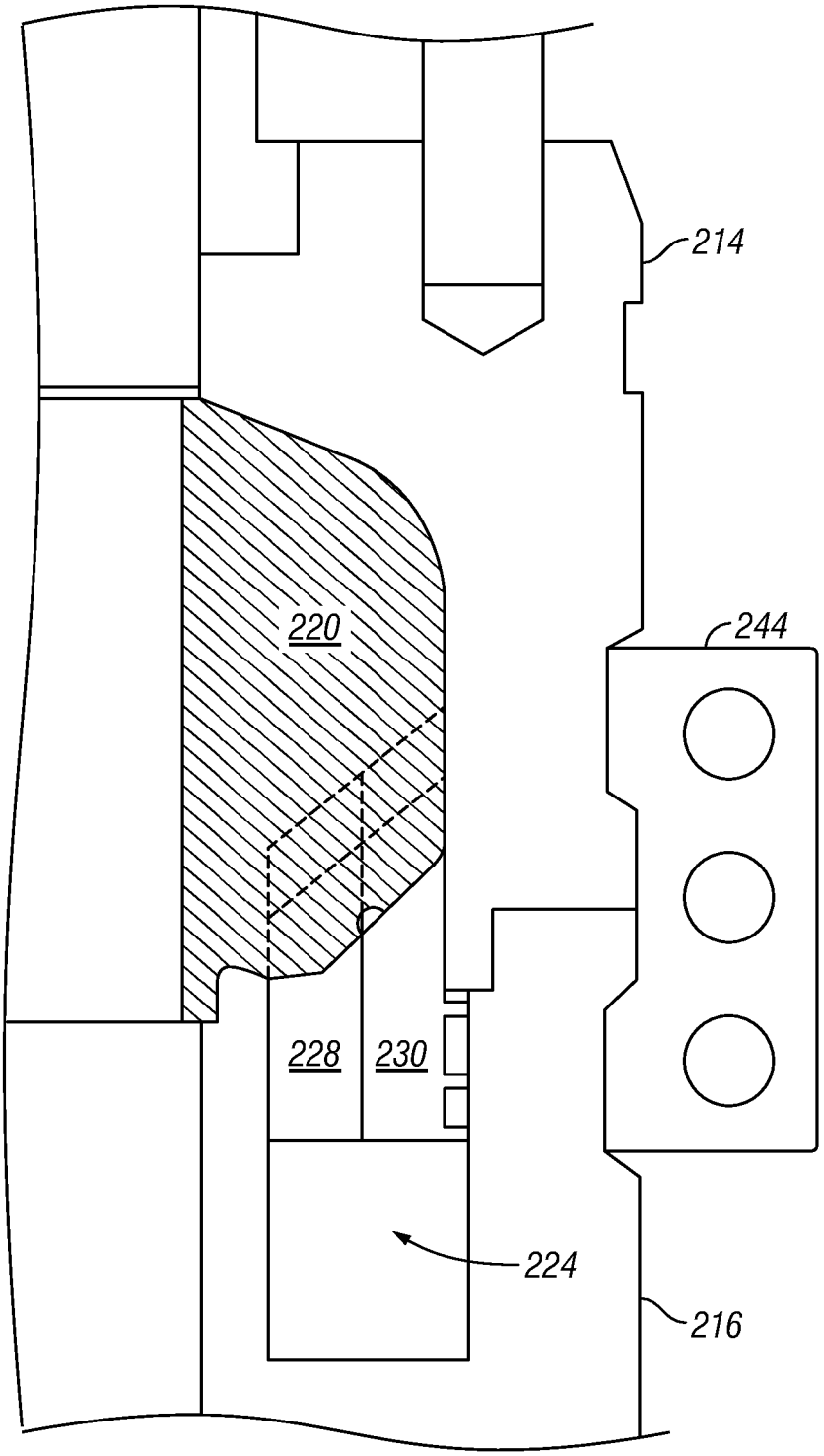
FIG. 4 shows a partial cross-sectional view of a telescoping joint packer assembly including a breech lock ring.

FIG. 4 illustrates a detailed view of the interface between the upper housing 214 and intermediate housing 216, including a lock ring 244. The dual piston ring assembly 224 is shown in the energized position, with both the inner piston ring 228 and the outer piston ring 230 shown engaged with the packer seal 220. The lock ring 244 is disposed radially about the packer seal assembly 202 and retains the upper housing 214 and intermediate housing 216 together. When the packer assembly 202 is in operation, the lock ring 244 is in a locked position. When packer seal 220 is to be replaced, the lock ring 244 is unlocked allowing the upper housing 214 and intermediate housing 216 to be separated, granting access to the packer seal 224. Lock ring 244 can be locked and unlocked manually by a user. In addition, lock ring 244 can be locked and unlocked by any other means suitable for rotating the lock ring, such as a hydraulic rotary motor device.

Figure 5:
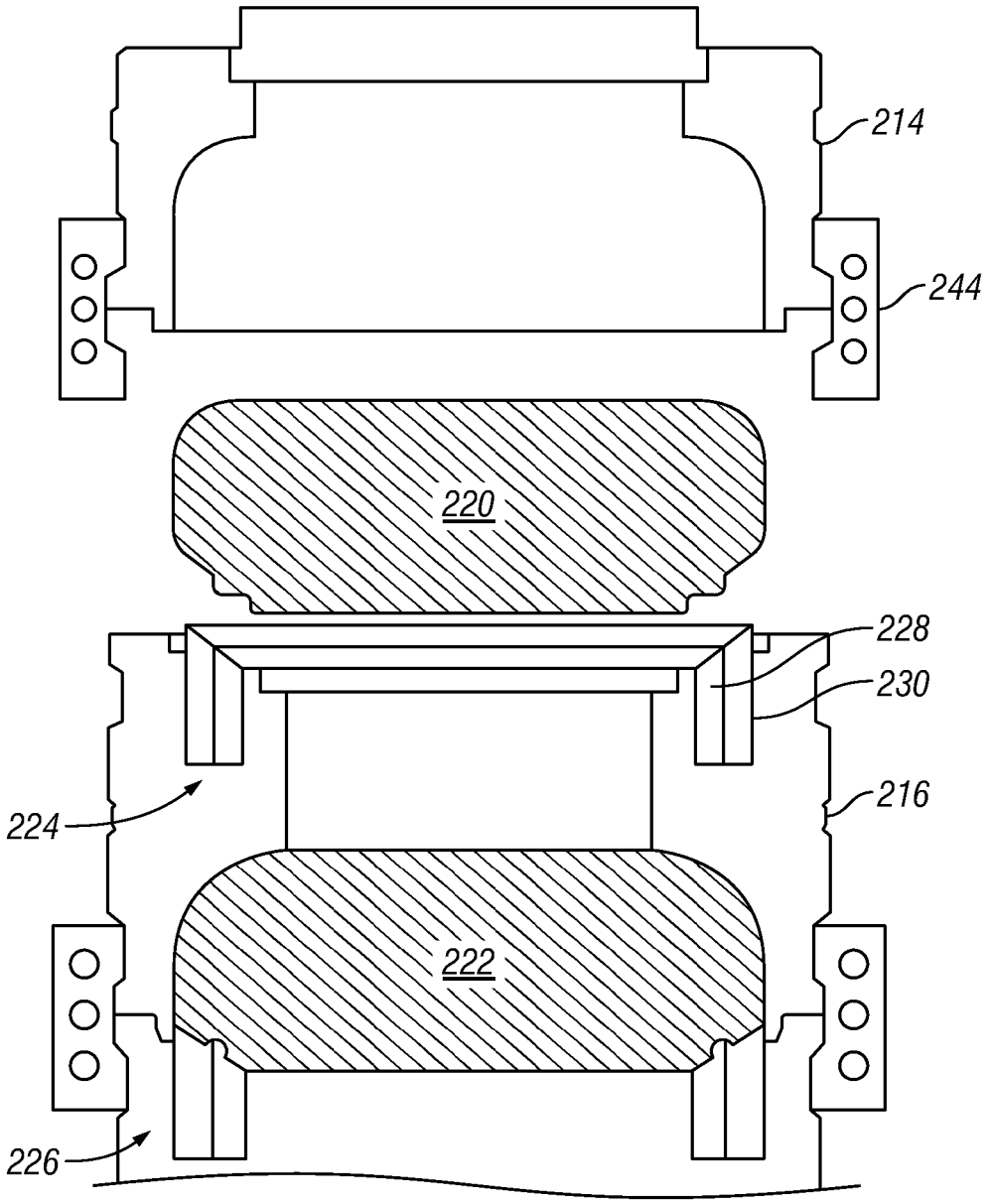
FIG. 5 shows a partial cross-sectional view of an inner housing assembly of a telescoping joint packer assembly.

As illustrated in FIG. 5, the lock ring 244 has been unlocked and the upper housing 214 and the intermediate housing 216 have been separated, allowing access and retrieval of packer seal 220. The packer seal 220 is shown removed from the packer seal assembly 202. After removal of packer seal 220, a replacement packer seal (not shown) can be installed. After installation of a new packer seal, upper housing 214 and intermediate housing 216 are then reassembled and the lock ring 244 is locked, retaining the housings together. As illustrated, the lock ring 244 provides lateral access to the packer assembly 202, and importantly to the respective packer seals, allowing for quicker seal access and retrieval compared to traditional packer assemblies wherein used packer seals had to be fished out of the assembly through the bore, i.e., from the top of the assembly. Lateral access to each individual packer seal further allows for replacement of individual packer seals.

Similar lock rings can be used to retain each piece of housing together with its adjacent housing. As illustrated in FIG. 2, the intermediate housing 216 and lower housing 218 are coupled by, inter alia, a lock ring. Similarly, the outer housing 242 is shown coupled to the lower outer housing 246 by, inter alia, a lock ring. These lock rings can be locked and unlocked as discussed above.

Figure 6:
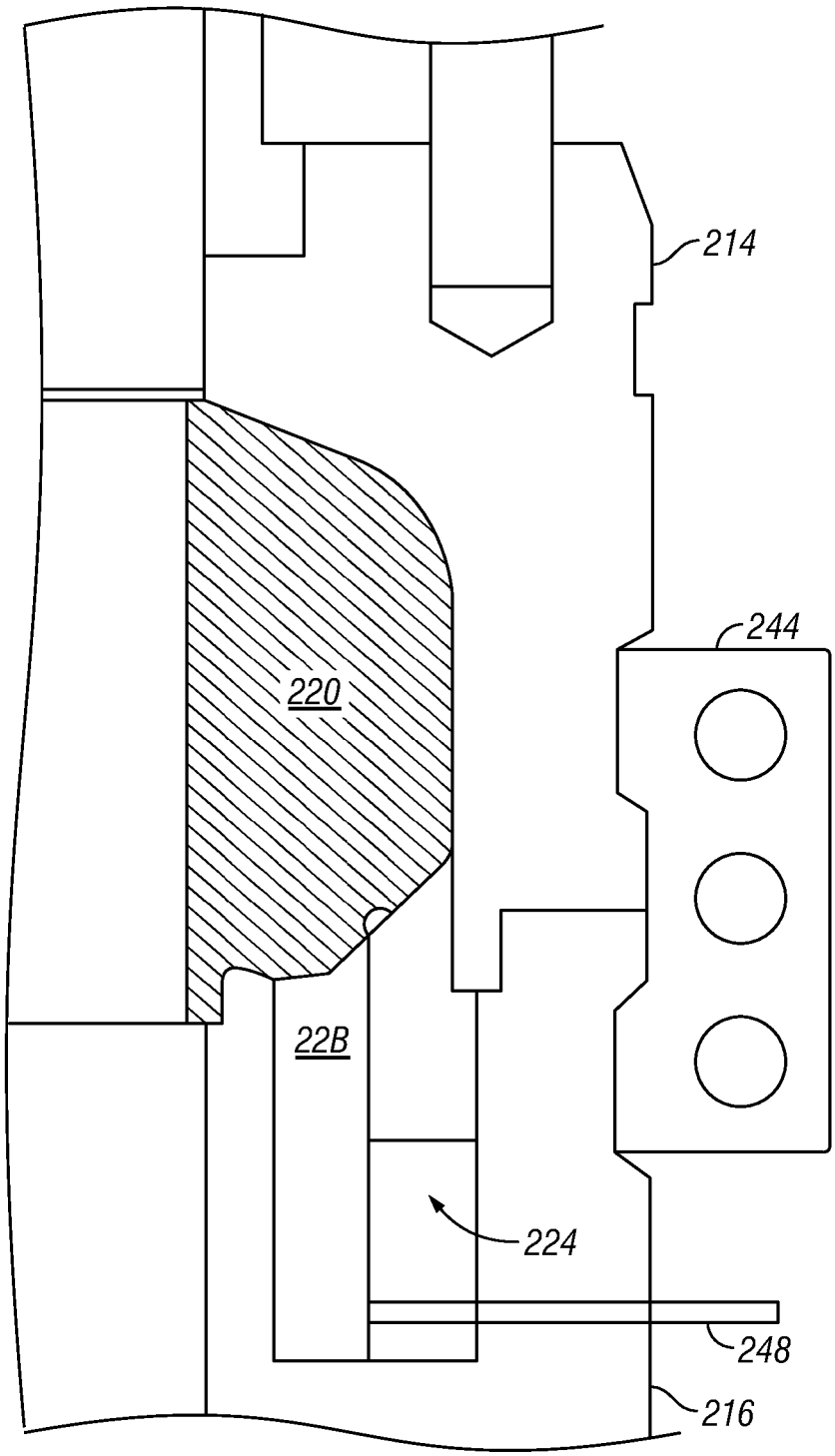
FIG. 6 shows a partial cross-sectional view of a telescoping joint packer assembly including a piston position indicator.

FIG. 6 illustrates a detailed view of the interface between the upper housing 214 and intermediate housing 216, including a lock ring 244. The dual piston ring assembly 224 is shown in the energized position, with both the outer piston ring 230 engaged with the packer seal 220. The inner piston ring 228 is not engaged with the packer seal 220. A piston position indicator 248 is inserted laterally into the packer assembly 202. The piston position indicator 248 is initially in contact with the outer piston ring 230. As the outer piston ring 230 moves upward to engage the packer seal 220, the piston position indicator 248 moves radially inward toward the center of the packer assembly to fill the space vacated by the outer piston ring 230.

Movement of the piston position indicator radially inward is indicative that the outer piston ring 230 has engaged the packer seal 220. In FIG. 6, the piston position indicator is in contact with the inner piston ring 228 which has not been actuated, i.e., has not moved upward to engage the packer seal 220. When the inner piston ring 228 moves upward to engage the packer seal 220, the piston position indicator will move further radially toward the center of the packer assembly to fill the space vacated by the inner piston ring 228. The length of the piston position indicator 248 protruding out of the packer assembly 202 will be indicative of the packer seal 220 wear. That is, the length of the piston position indicator 248 protruding out of the packer assembly 202 decreases as the piston position indicator 248 moves radially toward the center of the packer assembly 202.

Figure 7:
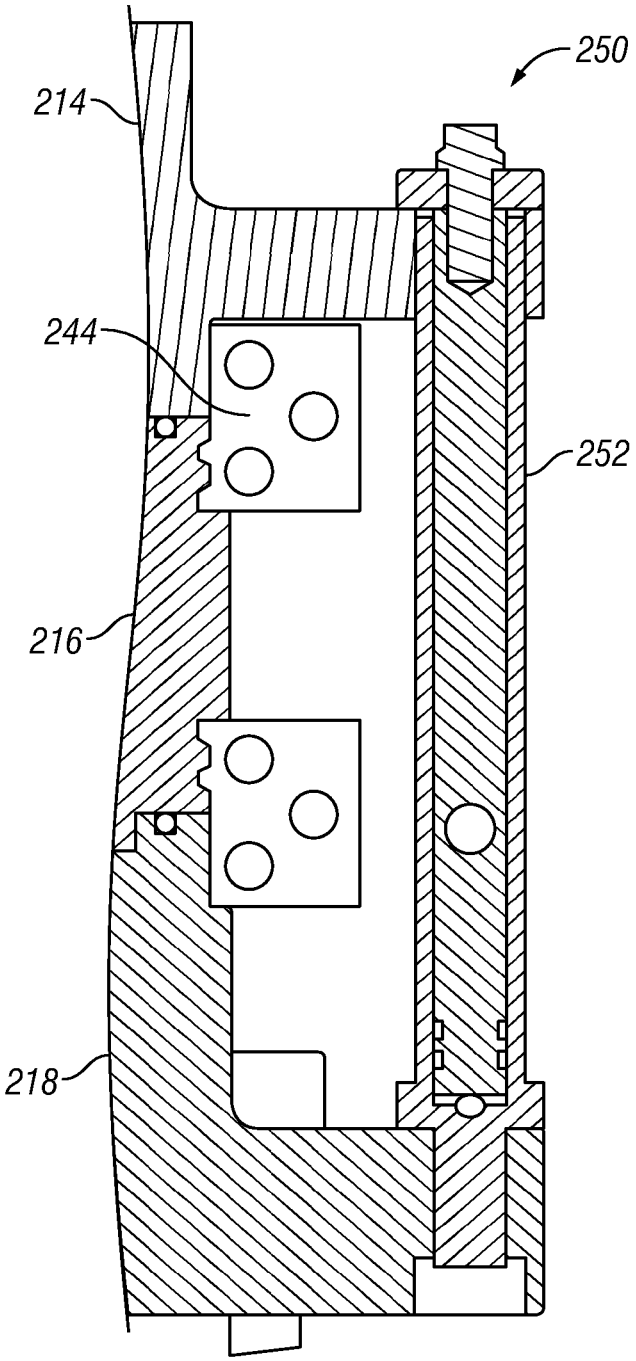
FIG. 7 shows a partial cross-sectional view of a telescoping joint packer assembly a hydraulic cylinder assembly.

FIG. 7 illustrates a detailed view of the interface between the upper housing 214, intermediate housing 216, and lower housing 218, including a lock ring 244 and a hydraulic cylinder assembly 250. The hydraulic cylinder assembly 250 is configured to provide for remote unlock of the breech lock ring 244. The hydraulic cylinder assembly 250 is disposed radially about the packer seal assembly 202 and comprises one or more hydraulic cylinders 252. The hydraulic cylinders 252 are extendable in a direction generally parallel to the longitudinal axis of the packer seal assembly 202. The hydraulic cylinders 252 are movable between an unextended position and an extended position. In the embodiment in FIG. 7, the hydraulic cylinders 252 are in an unextended position. Upon extension of the hydraulic cylinders 252 into an extended position, the upper housing 214, intermediate housing 216, and lower housing 218 are separated, thereby providing for lateral access to the packer seal(s) seated within the respective housings.

A cross-sectional view of a packer assembly 802 according to an embodiment of the present invention is illustrated in FIG. 8. The packer assembly 802 includes an upper housing 814, an intermediate housing 816, and a lower housing 818. The upper housing 814 includes an upper primary packer 820. The intermediate housing 816 includes an intermediate primary packer 822. The upper primary packer 820 and intermediate primary packer 822 can be energized independently of or together with each other, i.e., both upper primary packer 820 and intermediate primary packer 822 can be energized at the same time, only one of primary packer 820 and intermediate packer 822 can be energized, or neither primary packer 820 or intermediate packer 822 can be energized.

The packers 820 and 822 are energized by axially-oriented piston assemblies 824 and 826, respectively. Piston assemblies 824 and 826 are illustrated as dual piston ring assemblies, each comprising an inner piston ring 828 and an outer piston ring 830. However, any piston assembly suitable for axially activating a packer and known to those of ordinary skill in the art is envisioned. For instance, in some embodiments the piston assemblies 824 and 826 can be a single piston ring. In other embodiments, the piston assemblies 824 and 826 can include a plurality of piston rings. The number of rings in each piston assembly 824 and 826 is independent of the number of rings in the other piston assemblies.

Piston assemblies 824 and 826 are oriented along the longitudinal axis of the packer seal assembly 802, and are actuated by a signal provided from the surface, such as a hydraulic or electric signal. Each piston assembly 824 and 826 can be actuatable independently of or together with the other piston assembly. Further, the inner piston rings 828 can be actuatable independently from or together with the outer piston rings 830.

Although the embodiment illustrated in FIG. 8 shows an upper primary packer 820 and an intermediate primary packer 822, the number of packers may be varied. For instance, the packer seal assembly 802 may contain only a single packer. Alternatively, the packer seal assembly 802 may contain additional intermediate housings comprising additional packers so that the total number of packers disposed in the packer seal assembly 802 is two or more.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A packer assembly for dynamically sealing against an inner tubular of a telescoping joint, comprising:

an inner housing assembly positionable about the inner tubular of the telescoping joint, the inner housing assembly comprising a packer configured to form a dynamic seal between the packer and the inner tubular of the telescoping joint, the packer being axially energizable;

an outer housing assembly positionable about the inner tubular of the telescoping joint and axially from the inner housing assembly, the outer housing assembly comprising a packer configured to form a dynamic seal between the packer and the inner tubular of the telescoping joint, the packer being axially energizable; and a disconnect lock ring locatable around the packer assembly and movable between locked and unlocked configurations to retain or allow separation of the inner housing and outer housing assemblies.

2. The assembly of claim 1, further comprising a disconnect assembly disposed in the inner housing assembly, the disconnect assembly comprising the disconnect lock ring and a disconnect piston.

3. The assembly of claim 2, wherein the inner housing assembly is separable from the outer housing assembly when the disconnect lock ring is in the unlocked position.

4. The assembly of claim 1, wherein the inner housing assembly packer is axially energizable by an axially oriented piston comprising an inner piston ring and an outer piston ring.

5. The assembly of claim 4, further comprising a wear indicator comprising a pin laterally coupled to the assembly, the pin configured to move radially inward upon actuation of the piston, wherein the length of the pin protruding radially from the assembly is indicative of packer wear.

6. The assembly of claim 1, wherein the outer housing assembly packer is axially energizable by an axially oriented piston comprising an inner piston ring and an outer piston ring.

7. The assembly of claim 1, wherein the disconnect lock ring is locatable around the inner tubular to releasably lock the inner housing assembly and outer housing assembly together.

8. The assembly of claim 7, wherein the inner housing assembly packer is laterally retrievable when the disconnect lock ring is in an unlocked position.

9. The assembly of claim 7, further comprising a hydraulic cylinder assembly comprising one or more hydraulic cylinders disposed about the inner tubular, the one or more hydraulic cylinders being movable between an unextended position and an extended position.

10. The assembly of claim 1, wherein the inner housing assembly comprises a plurality of packers each configured to dynamically seal against the inner tubular of the telescoping joint, each packer being axially energizable.

11. A telescoping joint assembly comprising:

an outer tubular coupled to a subsea riser;

an inner tubular axially moveable within the outer tubular, the inner tubular coupled to a surface platform;

a packer assembly for sealing an annular space disposed between the inner tubular and the outer tubular, the packer assembly comprising:

an inner housing assembly positionable about the inner tubular of the telescoping joint, the inner housing assembly comprising a packer configured to form a dynamic seal between the packer and the inner tubular of the telescoping joint, the packer being axially energizable;

an outer housing assembly positionable about the inner tubular of the telescoping joint and axially from the inner housing assembly, the outer housing assembly comprising a packer configured to form a dynamic seal between the packer and the inner tubular of the telescoping joint, the packer being axially energizable; and a disconnect lock ring locatable around the packer assembly and movable between locked and unlocked configurations to retain or allow separation of the inner housing and outer housing assemblies.

12. The assembly of claim 11, further comprising a disconnect assembly disposed in the inner housing assembly, the disconnect assembly comprising the disconnect lock ring and a disconnect piston.

13. The assembly of claim 12, wherein the inner housing assembly is separable from the outer housing assembly when the disconnect lock ring is in an unlocked position.

14. The assembly of claim 11, wherein the packer is axially energizable by an axially oriented piston comprising an inner piston ring and an outer piston ring.

15. The assembly of claim 11, further comprising a wear indicator comprising a pin laterally coupled to the assembly, the pin configured to move radially inward upon actuation of the piston, wherein the length of the pin protruding radially from the assembly is indicative of packer wear.

16. The assembly of claim 11, wherein the piston is a dual piston ring assembly comprising an inner piston ring and an outer piston ring.

17. The assembly of claim 11, wherein the disconnect lock ring is locatable around the inner tubular to releasably lock the inner housing assembly and outer housing assembly together.

18. The assembly of claim 17, wherein the inner housing assembly packer is laterally retrievable when the disconnect lock ring is in an unlocked position.

19. The assembly of claim 17, further comprising a hydraulic cylinder assembly comprising one or more hydraulic cylinders disposed about the inner tubular, the one or more hydraulic cylinders being movable between an unextended position and an extended position.

20. The assembly of claim 11, wherein the inner housing assembly comprises a plurality of packers each configured to dynamically seal against the inner tubular of the telescoping joint, each packer being axially energizable.

21. A packer assembly for dynamically sealing against an inner tubular of a telescoping joint, comprising:

a housing assembly positionable about the inner tubular of the telescoping joint, the housing assembly comprising a packer configured to form a dynamic seal between the packer and the inner tubular of the telescoping joint, the packer being axially energizable;

a second housing assembly positionable about the inner tubular of the telescoping joint, the second housing assembly comprising a second packer configured to form a dynamic seal between the second packer and the inner tubular of the telescoping joint, the second packer being axially energizable; and a disconnect lock ring locatable around the packer assembly and movable between locked and unlocked configurations to retain or allow separation of the housing assembly and the second housing assembly.

* * * * *